US006377134B1

(12) United States Patent
Takenaka

(10) Patent No.: US 6,377,134 B1
(45) Date of Patent: Apr. 23, 2002

(54) PHASE SHIFTER HAVING TWO TRANSMISSION SIGNAL PATHS INDEPENDENTLY COUPLED WITH UNBALANCED SIGNAL TRANSMISSION PATH AND BALANCED SIGNAL TRANSMISSION PATH

(75) Inventor: Isao Takenaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/421,272

(22) Filed: Oct. 20, 1999

(30) Foreign Application Priority Data

Oct. 26, 1998 (JP) ..... 10-303527

(51) Int. Cl.[7] ..... H01P 1/18; H01P 5/10
(52) U.S. Cl. ..... 333/161; 333/26
(58) Field of Search ..... 333/161, 156, 333/26

(56) References Cited

U.S. PATENT DOCUMENTS 4,240,052 A * 12/1980 Hallford et al. ..... 333/26 X
5,025,232 A * 6/1991 Pavio ..... 333/26
5,172,082 A * 12/1992 Livingston et al. ..... 333/26
6,018,277 A * 1/2000 Vaisanen ..... 333/161 X
6,140,886 A * 10/2000 Fratti et al. ..... 333/26

OTHER PUBLICATIONS

G.J. Laughlin, "A New Impedance–Matched Wide–Band Balun and Magic Tee", IEEE Transactions on Microwave Theory and Techniques, vol. MTT–24, No. 3, Mar. 1976, pp. 135–141.

* cited by examiner

*Primary Examiner*—Benny Lee
(74) *Attorney, Agent, or Firm*—Sughrue Mion, PLLC

(57) ABSTRACT

A 180-degree phase shifter has two sets of transmission signal lines connected to one another and respectively coupled with an unbalanced signal transmission path connected to an input unbalanced signal terminal and a balanced signal transmission path connected output balanced signal terminals so that a designer can independently optimize the position of the input unbalanced signal terminal and the positions of the output balanced signal terminals.

16 Claims, 8 Drawing Sheets

PHASE SHIFTER HAVING TWO TRANSMISSION SIGNAL PATHS INDEPENDENTLY COUPLED WITH UNBALANCED SIGNAL TRANSMISSION PATH AND BALANCED SIGNAL TRANSMISSION PATH

FIELD OF THE INVENTION

This invention relates to a phase shifter and, more particularly, to a phase shifter available for a power amplifier, a balance-type modulator/demodulator and a mixer.

DESCRIPTION OF THE RELATED ART

The main function of the phase shifter is an electric power distribution from an unbalanced signal and a balanced signal different in phase from the unbalanced signal at a predetermined angle such as 180 degrees without changing the amplitude. For this reason, the 180-degree phase shifter is called as a balanced-unbalanced converter or simply as balun.

A small wide-band balun is proposed by G. J. Laughlin in "A New Impedance-Matched Wide-Band Balun and Magic Tree", IEEE Trans. Microwave Theory Tech., vol. MTT-24, No. 3, March 1976, page 135 to page 141, and is illustrated in FIG. 1. The prior art balun has an input terminal 51 assigned to an unbalance signal and output terminals 52/53 assigned to balance signals.

The prior art balun includes an unbalanced transmission line 54, two balanced transmission lines 58/59, a coupled transmission line 55 with an open-end and coupled transmission lines 56/57 each having a grounded end E and an open end. The transmission line 54 and the transmission line 55 connected to the transmission line 54 are coupled through the transmission lines 56 and 57 to the transmission lines 58 and 59, respectively. The unbalanced signal is supplied to the input terminal 51, and is propagated through the above-described transmission lines to the output terminals 52 and 53.

FIGS. 2A and 2B illustrate the arrangement and the structure of the prior art balun. The transmission lines 54, 55, 56, 57, 58 and 59 are patterned on a dielectric substrate 63, and the dielectric substrate 63 (see FIG. 2B) is 0.8 millimeter thick. The dielectric substrate 63 is formed of dielectric material, the dielectric constant of which is 2.2. The prior art balun is designed at 2.5 GHz, and introduces the phase difference of 180 degrees.

On the top surface of the dielectric substrate 63 are formed the transmission line 54 connected to the input terminal 51 to which the unbalanced signal is supplied, the open-ended transmission line 55 connected to the transmission line 54 and the transmission lines 58 and 59 respectively connected to the output terminals 52 and 53 from which the balanced signals are respectively output. The outlines of the transmission lines 54, 55, 58 and 59 and the input/output terminals 51, 52 and 53 are indicated by real lines in FIG. 2A. The other transmission lines 56 and 57 are patterned on the reverse surface of the dielectric substrate 63. The transmission lines 56 and 57 are open at one ends thereof, and are grounded through a box 60, as shown in FIG. 2A. The outlines of the transmission lines 56 and 57 are indicated by broken lines in FIG. 2A. The transmission line 56 is overlapped with the transmission lines 54 and 58 so as to be coupled through the dielectric substrate 63 with the transmission lines 54 and 58. On the other hand, the transmission line 57 is overlapped with the transmission lines 55 and 59 so as to be coupled through the dielectric substrate 63 with the transmission lines 55 and 59. The length of each transmission line is adjusted to a quarter wavelength of the signal at 2.5 GHz. In order to short-circuit one end of the transmission line 56 to one end of the transmission line 57, a cavity 64 is formed in the box, and the cavity 64 is 1.2 millimeter in depth, as shown in FIG. 2B.

FIG. 3A illustrates the transmission lines 54, 55, 58 and 59 patterned on the top surface of the dielectric substrate 63, and FIG. 3B illustrates the transmission lines 56 and 57 patterned on the reverse surface of the dielectric substrate 63. The periphery of the reverse surface is grounded, and is netted in FIG. 3B.

The prior art 180-degree phase shifter shown in FIGS. 2A and 2B is available for a power distribution/power composer of a power amplifier. In this instance, the designer encounters a problem in that he can not optimize the location of the input terminal 51 and the locations of the output terminals 52/53. In detail, the unbalanced signal input terminal 51 is coupled only through the transmission lines 56 and 57 with the balanced signal output terminals 52 and 53. This means that the unbalanced signal input terminal 51 and the balanced signal output terminals 52/53 set the limit on one another. The unbalanced signal is supplied from the input terminal 51 to the transmission line 54, and the transmission line 54 is coupled through the transmission line 56 serving as a ground electrode with the transmission line 58 from which the balanced signal is output. The open-ended transmission line 55 provides a quasi ground for the unbalanced signal, and is coupled through the transmission line 57 serving as the ground electrode with the transmission line 59 from which the balanced signal is output. Thus, the transmission line 54 on the top is to be overlapped with the transmission line 58 on the reverse surface, and the designer has to locate the transmission line 54 between broken lines A and B (see FIG. 2A). Thus, the prior art 180-degree phase shifter The prior art 180-degree phase shifter is further available for a push-pull power amplifier shown in FIG. 4A. The prior-art push-pull power amplifier includes 180-degree phase shifters 73 and 74, two power transistors 75 and composite circuit components 76 and 77. The two power transistors 75 are located between the composite circuit components 76 and 77, and each of the composite circuit components 76 and 77 has a bias circuit and a transmission line. The two power transistors 75 are shown in FIG. 4B. Gate electrodes 75*a* are located on one side, and drain electrodes 75*b* are located on the other side. Returning to FIG. 4A, gate bias terminals 78 and 79 are connected through the composite circuit component 76 to the gate electrodes 75*a* (see FIG. 4B), and drain bias terminals 80 and 81 are connected through the composite circuit component 76 to the drain electrodes 75*b* (see FIG. 4B).

An input power signal is supplied from an input terminal 71 to the prior art 180-degree phase shifter 73, and the prior art 180-degree phase shifter separates the input power signal into two power signals. The power signals are 180 degrees different in phase from each other, and are supplied through the composite circuit component 76 to the power transistors, respectively. The power transistors 75 operate at the phase difference, i.e., 180 degrees, and carry out the power amplification. The power transistors 75 supply the amplified power signals through the composite circuit component 76 to the prior art 180-degree phase shifter 74, and the prior art 180-degree phase shifter 74 composes an output power signal. The output power signal is supplied to an output terminal 72.

The prior art push-pull power amplifier is available for a high-power power amplifier. FIG. 5 illustrates the prior art high-power power amplifier. Plural prior art push-pull power amplifiers 45 are connected in parallel between a power distributor 43 and a power composer 44, and an input terminal 1 and an output terminal 21 are connected to the power distributor 43 and the power combiner 44, respectively. The push-pull power amplifiers 45 are similar in circuit configuration to the prior art push-pull power amplifier shown in FIG. 4A, and the 180-degree phase shifters 73/74 are incorporated in each of the push-pull power amplifiers 45. The unbalanced signal terminals of the 180-degree phase shifters 73/74 are arranged to be opposite to each other from the aspect that the plural push-pull power amplifiers are combined. However, the unbalanced signal terminal is coupled through transmission lines with the associated balanced signal terminal, and the designer can not independently locate the unbalanced terminal and the balanced terminal. In this situation, when the designer intends to combine the prior art push-pull power amplifier with other devices or circuits, the designer needs to arrange signal lines to connect the unbalanced/balanced terminals to the other devices or the circuits, and the signal lines tend to be complicated. This results in increase of the circuit board and decrease of the efficiency of power composition.

SUMMARY OF THE INVENTION

It is therefore an important object of the present invention to provide a phase shifter, which has an input terminal and output terminals independently locatable.

It is also an important object of the present invention to provide a phase shifter, which makes a power amplifier compact and enhances characteristics of the power amplifier.

To accomplish the object, the present invention proposes to associate a balanced signal transmission line and an unbalanced signal transmission line with transmission lines independently.

In accordance with one aspect of the present invention, there is provided a phase shifter comprising a first signal transmission path connected to an input signal port, a second signal transmission path connected to an output signal port, a third signal transmission path capacitively coupled with the first signal transmission path and a fourth signal transmission path connected to the third signal transmission path, capacitively coupled with the second signal transmission path and cooperating with the third signal transmission path for introducing a predetermined phase difference between the first signal transmission and the second signal transmission path.

BRIEF DESCRIPTION OF THE DRAWINGS

The features and advantages of the phase shifter will be more clearly understood from the following description taken in conjunction with the accompanying drawings in which.

DESCRIPTION OF THE PREFERRED EMBODIMENTS

Figure 6:
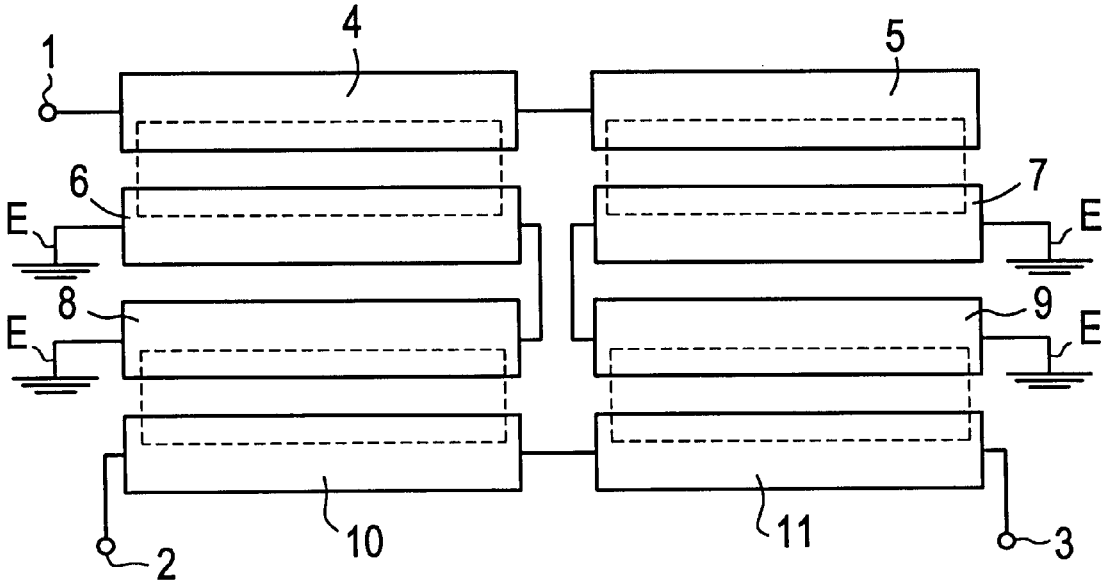
FIG. 6 is a circuit diagram showing the configuration of a phase shifter according to the present invention.

Referring to FIG. 6 of the drawings, a 180-degree phase shifter embodying, the present invention comprises an input unbalanced signal terminal 1, output balanced signal terminals 2 and 3 and eight transmission lines 4, 5, 6, 7, 8, 9, 10 and 11. An unbalanced signal is supplied to the input unbalanced signal terminal 1, and balanced signals are taken out from the output balanced signal terminals 2 and 3, respectively.

The transmission lines 4 and 5 propagate the unbalanced signal, and form an unbalanced signal transmission path. The input unbalanced signal terminal 1 is connected to one end of the signal transmission line 4, and the signal transmission line 4 has the other end connected to one end of the other transmission line 5. The other end of the transmission line 5 is opened.

The transmission lines 10 and 11 form a balanced signal transmission path. Phase difference of 180 degrees is introduced between the unbalanced signal transmission path and the balanced signal transmission path, and, accordingly, the unbalanced signal is converted to the balanced signals. The output balanced signal terminal 2 is connected to one end of the transmission line 10, and the other output balanced signal terminal 3 is connected to one end of the transmission line 11. The other end of the transmission line 10 is connected to the other end of the transmission line 11.

The transmission lines 6 and 7 and the transmission lines 8 and 9 are coupled with the unbalanced signal transmission path, i.e., the transmission lines 4 and 5 and the balanced signal transmission path, i.e., the transmission lines 8 and 9. The transmission line 6 has one end connected to the ground E, and the transmission line 8 also has one end connected to the ground E. The other end of the transmission line 6 is connected to the other end of the transmission line 8. Similarly, the transmission line 7 has one end connected to the ground E, and the transmission line 9 also has one end connected to the ground E. The other end of the transmission line 7 is connected to the other end of the transmission line 9.

The input unbalanced signal has a frequency of 2.5 GHz, and has a wavelength λ(see FIG. 7A), and each of the transmission lines 4 to 11 has a length adjusted to a quarter of the wavelength λ.

Figure 7A:
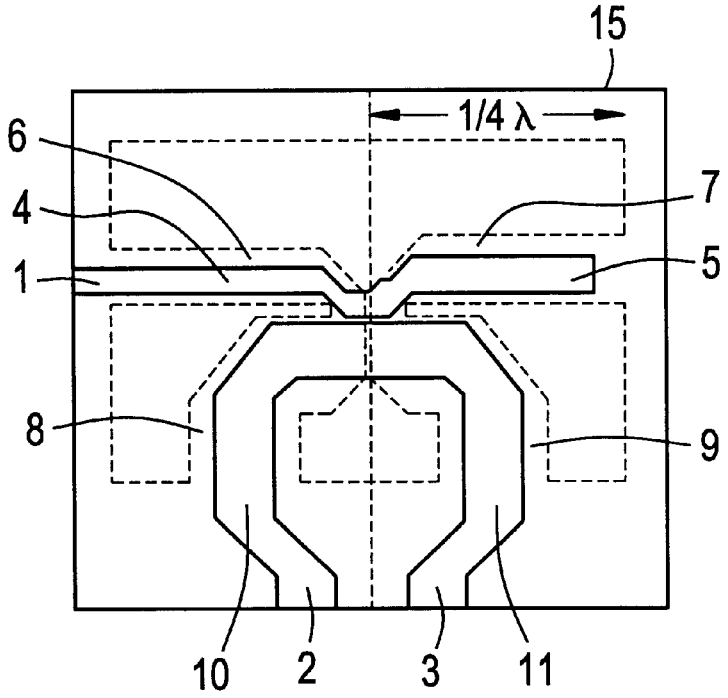
FIG. 7A is a plane view showing the arrangement of transmission lines incorporated in the phase shifter.

The transmission lines 4, 5, 10 and 11 are formed on a top surface of a dielectric substrate 15, and the other transmission lines 6, 7, 8 and 9 are formed on a reverse surface of the dielectric substrate 15 as best shown in FIG. 7A. The dielectric substrate 15 is 0.8 millimeter thick, and is formed of dielectric material having the dielectric constant of 2.2.

Figure 7B:
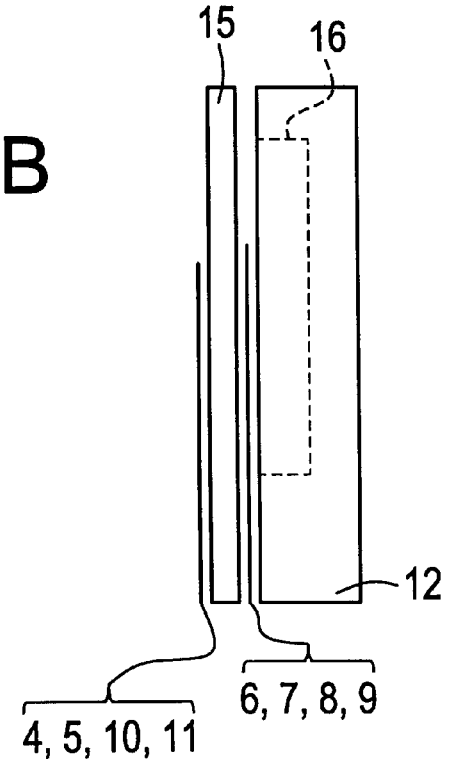
FIG. 7B is a side view showing the structure of the phase shifter.

The transmission lines 6 and 7 are respectively overlapped with the transmission lines 4 and 5, and, accordingly, are coupled through the dielectric substrate 15 with the transmission lines 4 and 5, respectively. The transmission lines 8 and 9 are respectively overlapped with the transmission lines 10 and 11, and, accordingly, are coupled through the dielectric substrate 15 with the transmission lines 10 and 11, respectively. The transmission lines 6, 7, 8 and 9 are grounded through a box 12 as shown in FIG. 7B.

In other words, the unbalanced signal transmission path 4/5 and the balanced signal transmission path 10/11 are accompanied with two pairs of transmission lines 6/7 and 10/11, respectively. Even if the unbalanced signal transmission path 4/5 is differently located on the top surface of the dielectric substrate 15 together with the input unbalanced signal terminal 1, the influence is limited to the transmission lines 6 and 7, only. This means that the transmission lines 8 and 9 and, accordingly, the output balanced signal terminals 2 and 3 are not changed. Similarly, if the designer differently arranges the output balanced signal terminals 2 and 3 and, accordingly, the transmission lines 10 and 11, only the transmission lines 8 and 9 are differently located, and the transmission lines 6/7 and, accordingly, the transmission lines 4/5 and the input unbalanced signal terminal 1 are allowed to be on the top 3 surface of the dielectric substrate 15 without change.

Figure 8A:
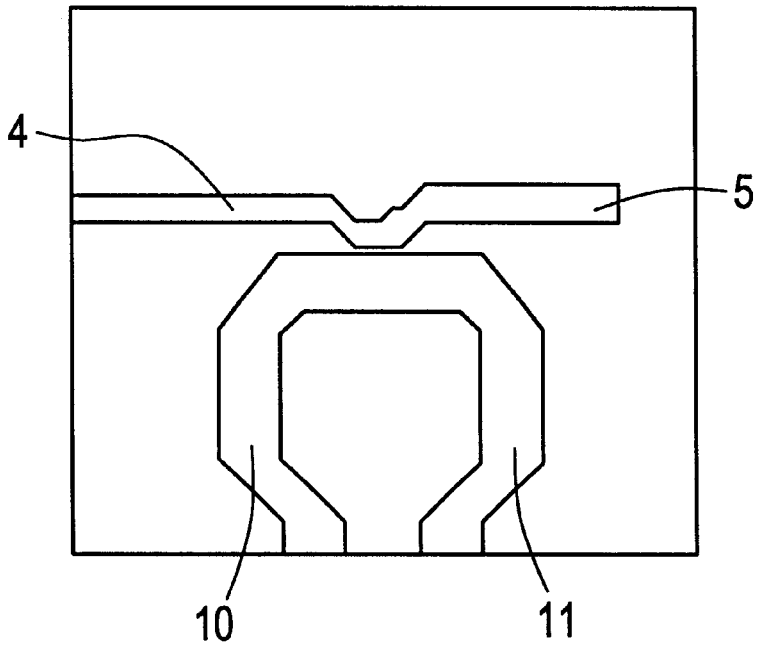
FIG. 8A is a plane view showing the pattern of the transmission lines on the top surface of a dielectric substrate incorporated in the phase shifter.

The input unbalanced signal terminal 1 is at 50 ohms, and each of the output balanced signal terminals 2 and 3 is at 25 ohms. The transmission lines 4 to 11 are regulated in such a manner so as to achieve impedance matching. In this instance, the transmission line 4 is 24 millimeters long and 2.1 millimeters wide. The transmission line 5 is also 24 millimeters long and 3.2 millimeters wide. The transmission line 10 is also 24 millimeters long and 5.5 millimeters wide. The transmission line 11 is also 24 millimeters long and 5.5 millimeters wide. Thus, the transmission line 4 is different in width from the transmission line 5, and the transmission line 10 is equal in width to the transmission line 11 (see FIG. 8A).

Figure 8B:
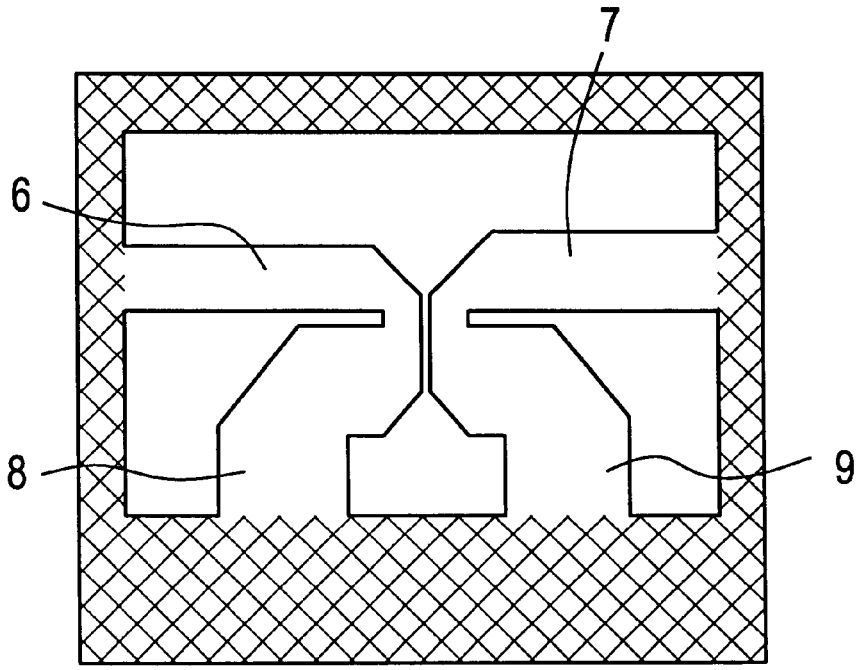
FIG. 8B is a bottom view showing the pattern of transmission lines on the reverse surface of the dielectric substrate incorporated in the phase shifter.

The transmission line 6 is also 24 millimeters long and 3.5 millimeters wide, and the transmission line 7 is also 24 millimeters long and 3.5 millimeters wide. The transmission line 8 is also 24 millimeters long and 7 millimeters wide, and the transmission line 9 is also 24 millimeters long and 7 millimeters wide. A cavity 16 is open to a central area of the box 12 (see figure 7B), and is 1.2 millimeter in depth. Each of the transmission lines 6, 7, 8 and 9 is connected at one end thereof to a peripheral area of the box 12 (see FIG. 8B), and the transmission lines 6, 7, 8 and 9 are short-circuited through the peripheral area. The peripheral area is netted in FIG. 8B for better under-standing.

Figure 9A:
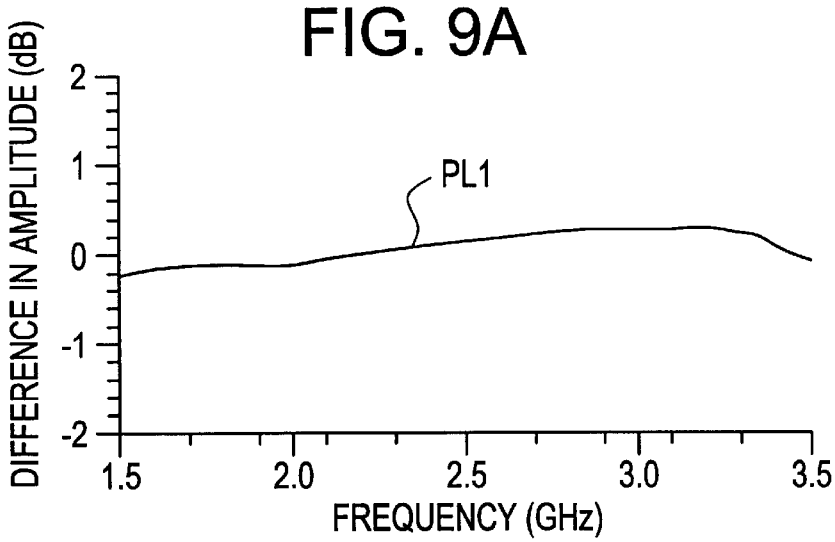
FIG. 9A is a graph showing the relation between the frequency of an unbalanced signal and a difference in amplitude between balanced signals.
Figure 9B:
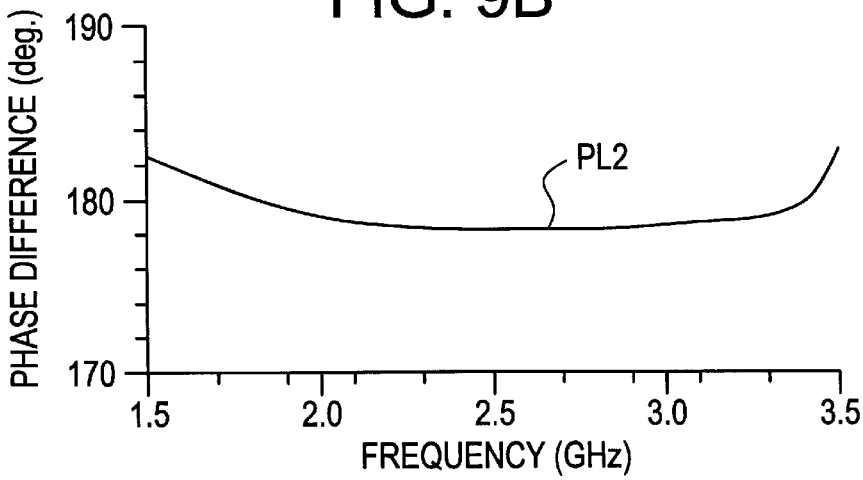
FIG. 9B is a graph showing the relation between the frequency of the unbalanced signal and a phase difference between the balanced signals.
Figure 9C:
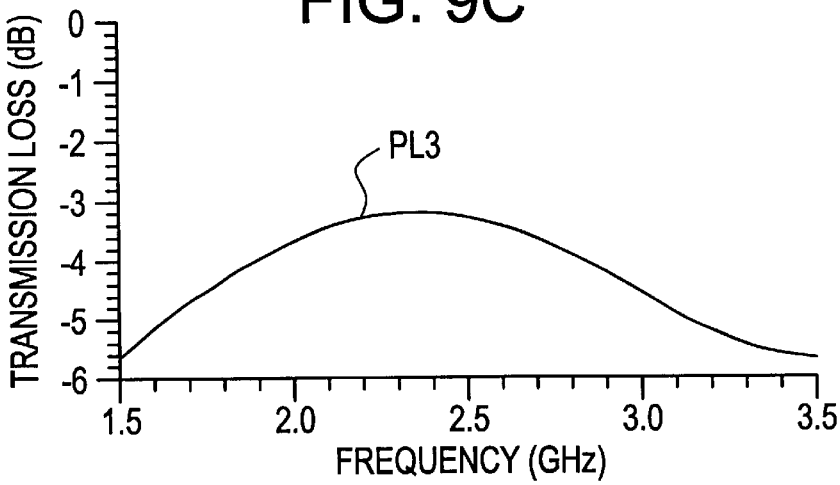
FIG. 9C is a graph showing the relation between the frequency of the unbalanced signal and a difference in transmission loss between the balanced signals.

The present inventor evaluated the 180-degree phase shifter. The present inventor applied the unbalanced signal to the input unbalanced signal terminal 1, and measured the amplitude, the phase and the transmission loss for the balanced signals at the output balanced signal terminals 2 and 3. The present inventor varied the frequency of the unbalanced signal, and plotted the difference in amplitude, the phase difference and the difference in transmission loss between the balanced signal at the output balanced signal terminal 2 and the balanced signal at the output balanced signal terminal 3 as indicated by plots PL1, PL2 and PL3 in FIGS. 9A, 9B and 9C.

Frequency f0 was assumed to be 2.5 GHz. The unbalanced signal was varied in the wide range ±0.35f0. As will be understood from FIGS. 9A, 9B and 9C, the difference in amplitude was equal to or less than 0.2 dB, the phase difference was 180 degrees ±5 degrees, and the transmission loss was equal to or less than 0.5 dB with respect to −3 dB. Thus, the phase shifter according to the present invention achieved the good characteristics.

As will be appreciated from the foregoing description, the phase shifter according to the present invention has two pairs of transmission lines 6/7 and 8/9 independently coupled through the dielectric substrate 15 with the unbalanced signal transmission path 4/5 and the balanced signal transmission path 10/11. Even if a designer rearranges one of the unbalanced signal transmission path 4/5 and the balanced signal transmission path 10/11, the influence is limited to the associated transmission lines 6/7 or 8/9. This feature is desirable, because the designer freely arranges the input unbalanced signal terminal 1 and the output balanced signal terminals 2/3. Thus, the present invention enhances the design flexibility.

The 180-degree phase-shifter according to the present invention is available for a power amplifier. When the 180-degree phase shifter is used in the power amplifier, the designer makes the arrangement of signal lines simple, because the input unbalanced signal terminal 1 and the output balanced signal terminals 2/3 are independently formed at optimum positions on the dielectric substrate 15. As a result, the power amplifier becomes compact, and the performance is enhanced.

Figure 10A:
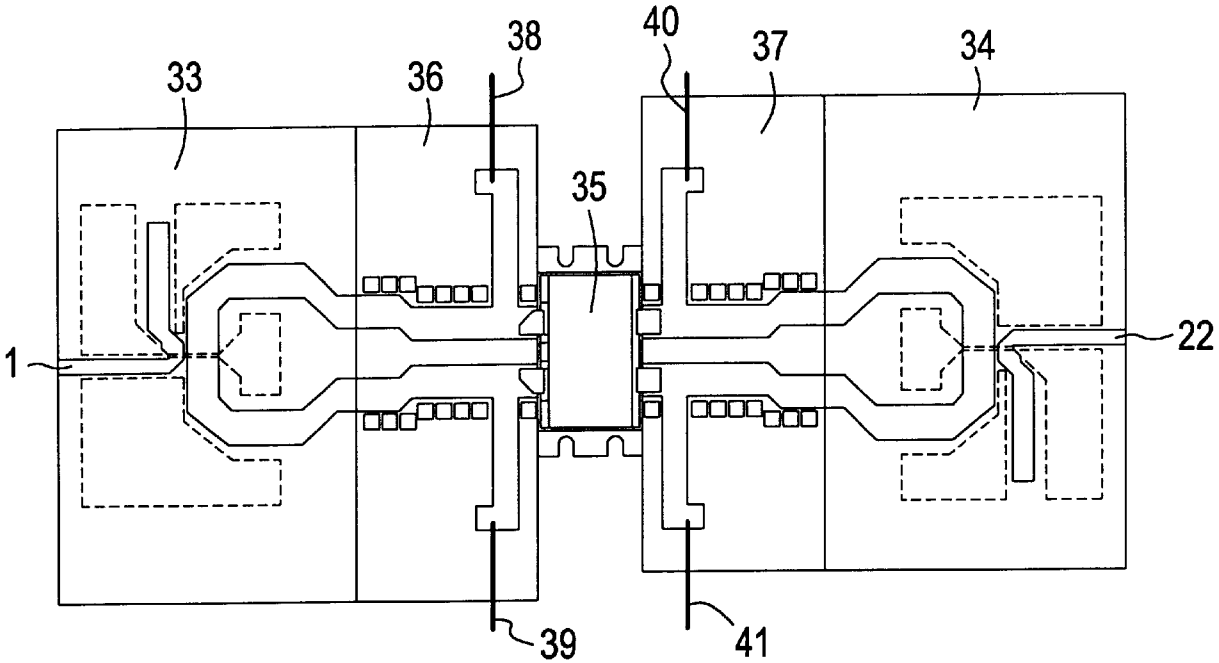
FIG. 10A is a plane view showing the arrangement of a push-pull power amplifier equipped with the phase shifters according to the present invention.
Figure 10B:
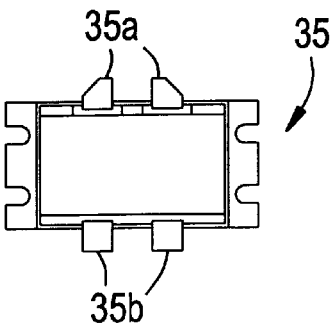
FIG. 10B is a plane view showing power transistors incorporated in the push-pull power amplifier.

FIG. 10A illustrates a push-pull power amplifier, and 180-degree phase shifters 33/34 are incorporated in the push-pull power amplifier. The 180-degree phase shifter 33 is connected to a composite circuit component 36, which in turn is connected to two power transistors 35. A bias circuit and transmission lines are incorporated in the composite circuit component 36. As shown in 10B, the power transistors 35 has two gate electrodes 35*a* and two drain electrodes 35*b*.

Returning to FIG. 10A, power transistors 35 are connected to another composite circuit component 37, which in turn is connected to the other 180-degree phase shifter 34. A bias circuit and transmission lines are also incorporated in the composite circuit component 37. Gate bias terminals 38 and 39 are connected to the composite circuit component 36, and drain bias terminals 40 and 41 are connected to the other composite circuit component 37. Thus, the 180-degree phase shifters 33/34 are integrated together with the composite circuit components 36/37 and the power transistors 35, and the push-pull power amplifier is a kind of microwave integrated circuit.

The unbalanced signal transmission path of each 180-degree phase shifter 33/34 is arranged differently from the unbalanced signal transmission path 4/5 shown in FIG. 7A. However, the unbalanced signal transmission path does not have any influence on the associated balanced signal transmission path. Thus, the designer can independently arrange the unbalanced signal transmission path and the balanced signal transmission path on the dielectric substrate so as to optimize the input unbalanced signal terminal 1 and the output unbalanced signal terminal 22 as shown in FIG. 10A.

The 180-degree phase shifter produces two signals 180 degrees different in phase from an input signal, and the two signals are supplied to the power transistors 35, respectively. The power transistors amplify the two signals, and the phase shifter 34 produces an output signal from the two signals.

Figure 1:
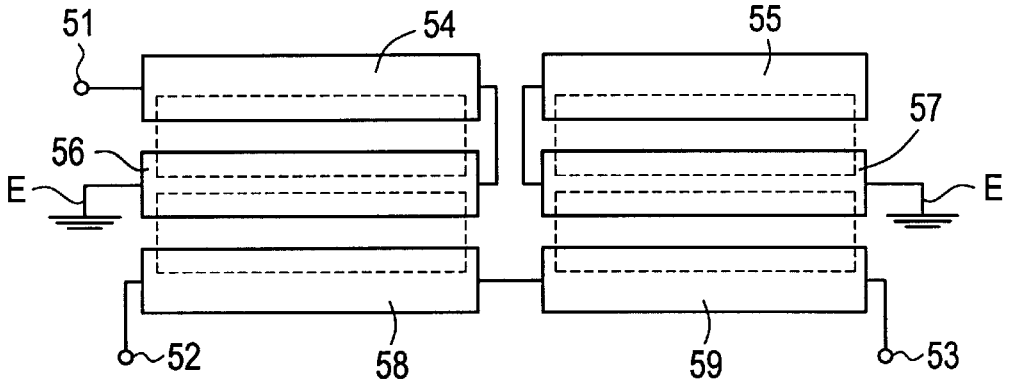
FIG. 1 PRIOR ART
FIG. 1 is a circuit diagram showing the prior art balun disclosed in the IEEE.
Figure 2A:
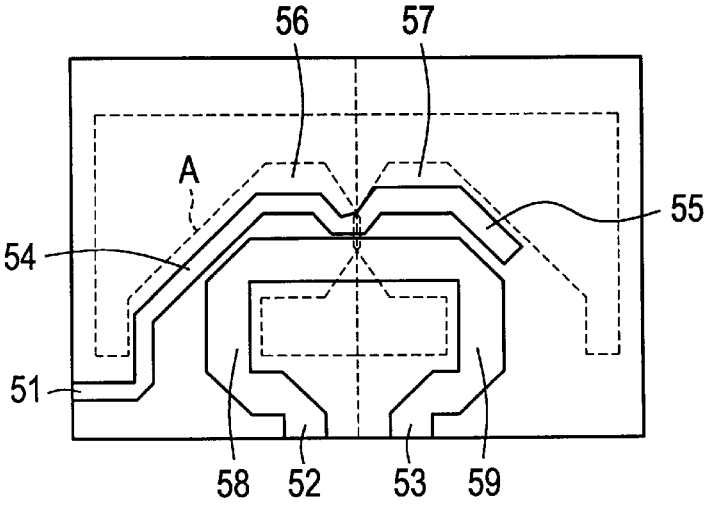
FIG. 2A PRIOR ART
FIG. 2A is a plane view showing the arrangement of the transmission lines incorporated in the prior art balun.
Figure 2B:
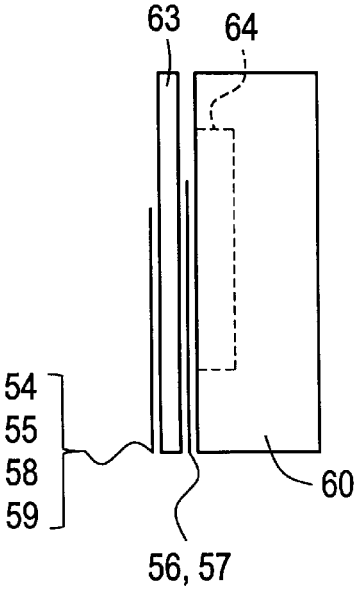
FIG. 2B PRIOR ART
FIG. 2B is a side view showing the structure of the prior art balun.
Figure 3A:
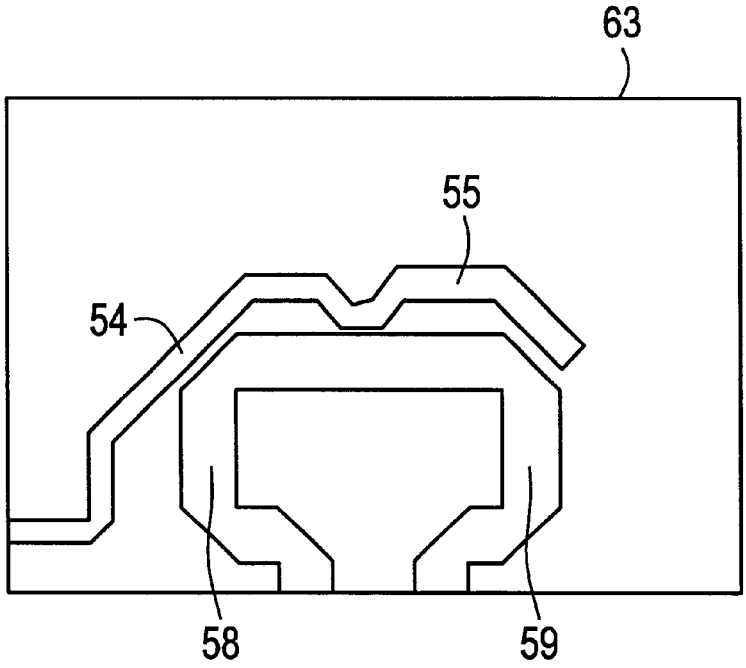
FIG. 3A PRIOR ART
FIG. 3A is a plane view showing the transmission lines formed on the top surface of the dielectric substrate forming the part of the prior art balun.
Figure 3B:
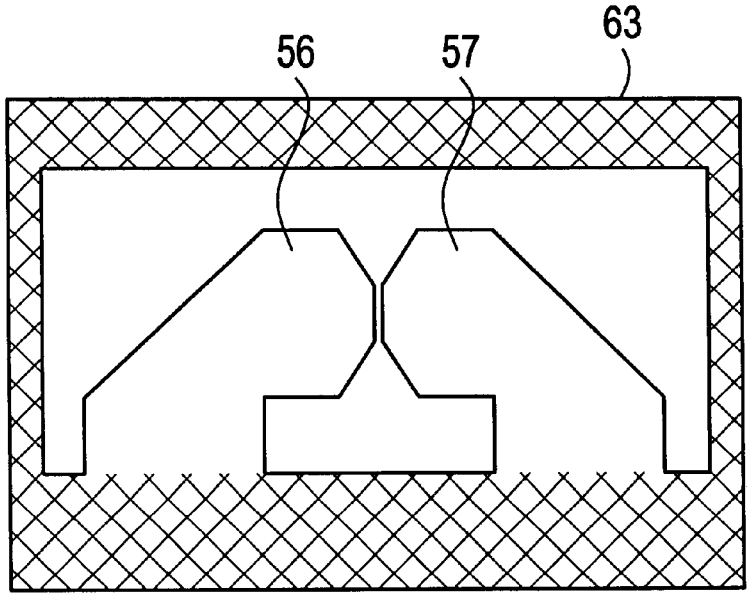
FIG. 3B PRIOR ART
FIG. 3B is a bottom view showing the transmission lines formed on the reverse surface of the dielectric substrate.
Figure 4A:
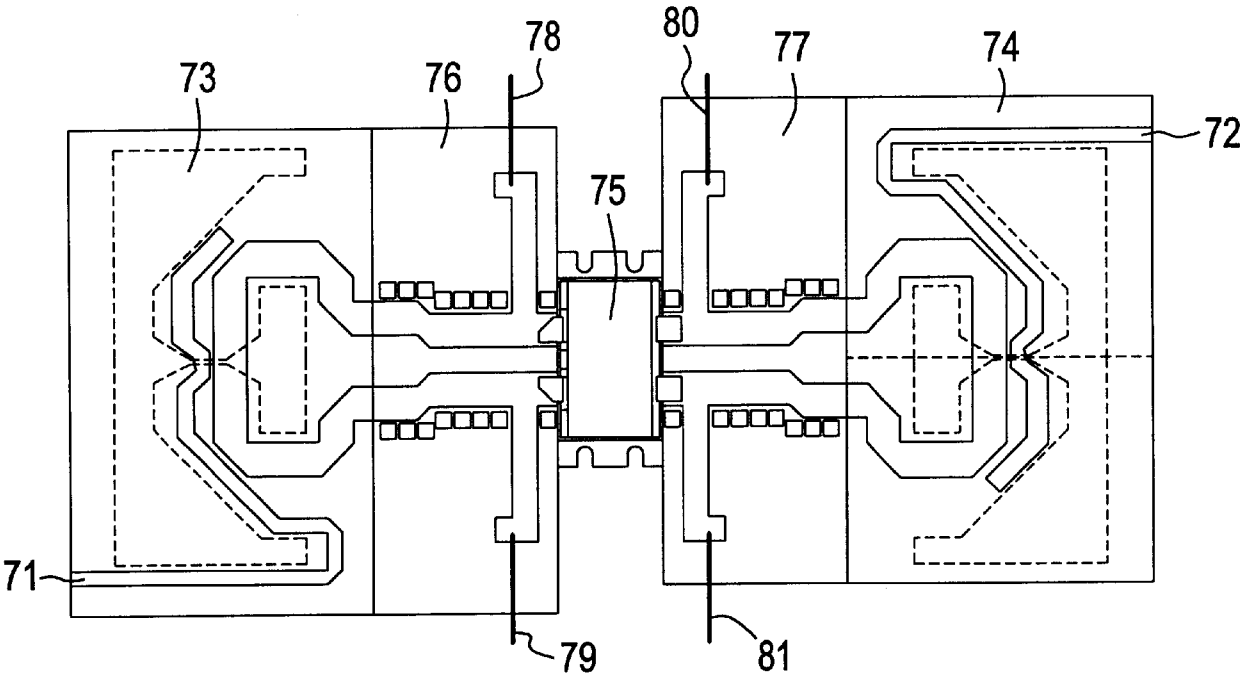
FIG. 4A PRIOR ART
FIG. 4A is a plane view showing the arrangement of the prior art push-pull power amplifier.
Figure 4B:
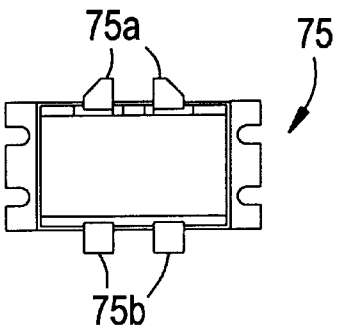
FIG. 4B PRIOR ART
FIG. 4B is a plane view showing the arrangement of the power transistor incorporated in the prior art push-pull power amplifier.
Figure 5:
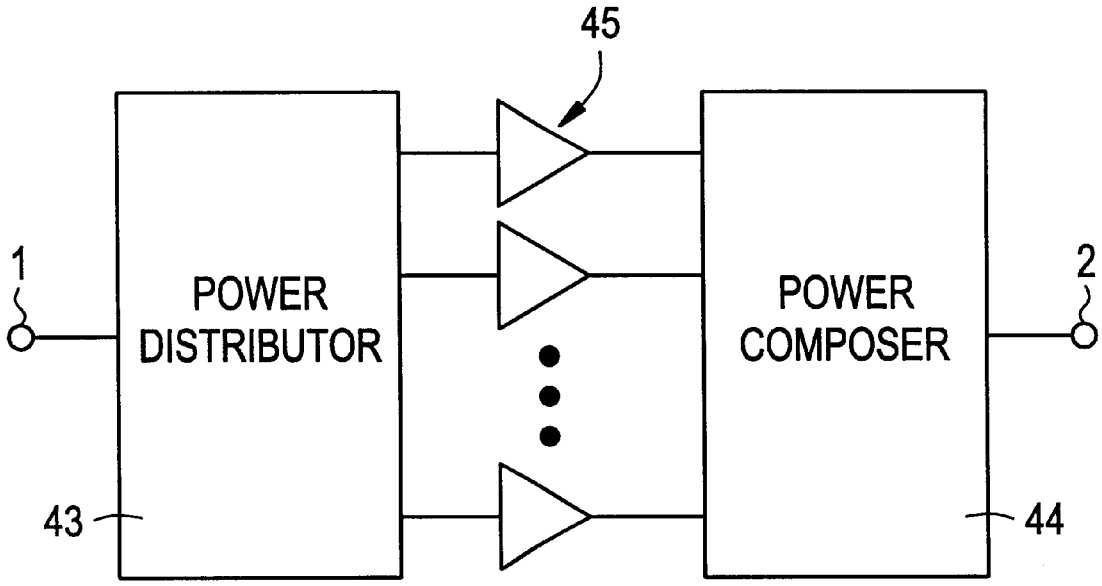
FIG. 5 PRIOR ART
FIG. 5 is a circuit diagram showing the arrangement of the prior art high-power power amplifier.

The two output balanced signal terminals of the 180-degree phase shifters 33/34 are opposed to each other. The push-pull power amplifier shown in FIG. 10A is available for the high-power power amplifier shown in FIG. 5. The input unbalanced signal terminals 1 of the 180-degree phase shifters 33/34 are symmetrical with each other, and the designer easily combine the plural push-pull power amplifiers.

Although a particular embodiment of the present invention has been shown and described, it will be apparent to those skilled in the art that various changes and modifications may be made without departing from the spirit and scope of the present invention.

For example, the transmission lines 6, 7, 8 and 9 and the transmission lines 4, 5, 10 and 11 may be formed on the top surface and the reverse surface, respectively.

Another phase shifter according to the present invention may introduce a phase difference not equal to 180 degrees, and produce more than two output signals.

What is claimed is:

1. A phase shifter comprising:

a first signal transmission path connected to an input signal port, a second signal transmission path connected to an output signal port, a third signal transmission path capacitively coupled with said first signal transmission path, and a fourth signal transmission path connected to said third signal transmission path, capacitively coupled with said second signal transmission path and cooperating with said third signal transmission path for introducing a predetermined phase difference between said first signal transmission path and said second signal transmission path, wherein said input signal port includes an input signal terminal, and said output signal port includes a first output signal terminal and a second output signal terminal.

2. The phase shifter as set forth in claim 1, in which said input signal port, said first signal transmission path and said second signal transmission path are formed on a first surface of a dielectric substrate, said output signal port, said third signal transmission path and said fourth signal transmission path are formed on a second surface of said dielectric substrate reverse to said first surface.

3. The phase shifter as set forth in claim 2, in which said first signal transmission path and said second signal transmission path are respectively over-lapped with said third signal transmission path and said fourth signal propagation path.

4. The phase shifter as set forth in claim 1, in which an input signal is supplied to said input signal terminal, and a first output signal and a second output signal are output from said first output signal terminal and said second output signal terminal, respectively.

5. The phase shifter as set forth in claim 4, in which said first output signal and said second output signal are different in phase from said input signal by said predetermined phase difference, and said predetermined phase difference is 180 degrees.

6. The phase shifter as set forth in claim 5, in which said first signal transmission path includes a first transmission line having one end connected to said input signal terminal and a second transmission line having one end connected to the other end of said first transmission line and the other open end, said second signal transmission path includes a third transmission line having one end connected to said first output signal terminal and a fourth transmission line having one end connected to said second output signal terminal and the other end connected to the other end of said third transmission line, said third signal transmission path includes a fifth transmission line having one short-circuited end and a sixth transmission line having one short-circuited end, and said fourth signal transmission path includes a seventh transmission line having one short-circuited end and the other end connected to the other end of said fifth transmission line and an eighth transmission line having one short-circuited end and the other end connected to the other end of said sixth transmission line.

7. The phase shifter as set forth in claim 6, said phase shifter forms a part of a microwave integrated circuit.

8. The phase shifter as set forth in claim 7, in which said microwave integrated circuit is a push-pull power amplifier.

9. The phase shifter as set forth in claim 6, in which said input signal terminal, said first transmission line, said second transmission line, said third transmission line and said fourth transmission line are formed on an upper surface of a dielectric substrate, and said first output terminal, said second output terminal, said fifth transmission line, said sixth transmission line, said seventh transmission line and said eighth transmission line are formed on a lower surface of said dielectric substrate reverse to said upper surface.

10. The phase shifter as set forth in claim 9, in which said first transmission line, said second transmission line, said third transmission line and said fourth transmission line are respectively overlapped with said fifth transmission line, said sixth transmission line, said seventh transmission line and said eighth transmission line.

11. The phase shifter as set forth in claim 10, in which said first transmission line, said second transmission line, said third transmission line, said fourth transmission line, said fifth transmission line, said sixth transmission line, said seventh transmission line and said eighth transmission line each have a length equal to a quarter wavelength of said input signal.

12. The phase shifter as set forth in claim 6, further comprising a box having a recess open to a central area and a conductive peripheral area contacting said one short-circuited end of said fifth transmission line, said one short-circuited end of said sixth transmission line, said one short-circuited end of said seventh transmission line and said one short-circuited end of said eighth transmission line.

13. The phase shifter as set forth in claim 12, said first output terminal, said fifth transmission line, said sixth transmission line, said seventh transmission line and said eighth transmission line are formed on a lower surface of a dielectric substrate faced to said box, and said input signal terminal, said first transmission line, said second transmission line, said third transmission line and said fourth transmission line are formed on an upper surface of said dielectric substrate reverse to said lower surface.

14. The phase shifter as set forth in claim 13, in which said first transmission line, said second transmission line, said third transmission line and said fourth transmission line are respectively overlapped through said dielectric substrate with said fifth transmission line, said sixth transmission line, said seventh transmission line and said eighth transmission line.

15. The phase shifter as set forth in claim 14, in which said first transmission line, said second transmission line, said third transmission line, said fourth transmission line, and said fifth transmission line, said sixth transmission line, said seventh transmission line and said eighth transmission line each have a length equal to a quarter of a wavelength of said input signal, and said dielectric substrate has a thickness of 0.8 millimeter and a dielectric constant of 2.2.

16. The phase shifter as set forth in claim 6, in which said first transmission line, said second transmission line, said third transmission line, said fourth transmission line, said fifth transmission line, said sixth transmission line, said seventh transmission line and said eighth transmission line each have a length equal to a quarter wavelength of said input signal.

* * * * *